US010711535B2

(12) United States Patent
Simpson

(10) Patent No.: US 10,711,535 B2
(45) Date of Patent: Jul. 14, 2020

(54) DOWNHOLE APPARATUS AND METHOD

(71) Applicant: PARADIGM DRILLING SERVICES LIMITED, Aberdeenshire (GB)

(72) Inventor: Neil Andrew Abercrombie Simpson, Aberdeen (GB)

(73) Assignee: PARADIGM DRILLING SERVICES LIMITED, Aberdeenshire (GB)

( * ) Notice: Subject to any disclaimer, the term of this patent is extended or adjusted under 35 U.S.C. 154(b) by 664 days.

(21) Appl. No.: 14/894,625

(22) PCT Filed: May 29, 2014

(86) PCT No.: PCT/GB2014/051645
§ 371 (c)(1),
(2) Date: Nov. 30, 2015

(87) PCT Pub. No.: WO2014/191752
PCT Pub. Date: Dec. 4, 2014

(65) Prior Publication Data

US 2016/0130886 A1 May 12, 2016

(30) Foreign Application Priority Data

May 29, 2013 (GB) ..... 1309853.8

(51) Int. Cl.
*E21B 17/10* (2006.01)
*E21B 4/00* (2006.01)

(52) U.S. Cl.
CPC ..... *E21B 17/1085* (2013.01); *E21B 4/003* (2013.01); *E21B 17/1042* (2013.01); *E21B 17/1057* (2013.01)

(58) Field of Classification Search
CPC ..... E21B 17/1085; E21B 17/1042; E21B 17/1057; E21B 4/003
See application file for complete search history.

(56) References Cited

U.S. PATENT DOCUMENTS 4,240,683 A * 12/1980 Crase ..... E21B 4/003 175/320
4,260,031 A 4/1981 Jackson, Jr.
4,549,613 A 10/1985 Case
5,803,193 A 9/1998 Krueger et al.
6,032,748 A 3/2000 DeBray et al.
(Continued)

FOREIGN PATENT DOCUMENTS

CN 2457322 Y 10/2001
CN 101260788 A 9/2008
(Continued)

OTHER PUBLICATIONS

International Search Report and Written Opinion dated Jan. 27, 2015 in International Patent Application No. PCT/GB2014/051645.

*Primary Examiner* — David J Bagnell
*Assistant Examiner* — Yanick A Akaragwe
(74) *Attorney, Agent, or Firm* — William H. Honaker; Dickinson Wright PLLC

(57) ABSTRACT

A bearing (12) for a downhole apparatus (10) comprises a body (42) and an upset portion (44). The upset portion (44) extends radially outwards from the body (42), the body (42) and the upset portion (44) defining a channel (46) for receiving fluid flow for lubricating the bearing (12).

30 Claims, 3 Drawing Sheets

(56) References Cited

U.S. PATENT DOCUMENTS

| | | | | |
|---|---|---|---|---|
| 6,416,225 | B1 * | 7/2002 | Cioceanu | E21B 4/003 175/107 |
| 2002/0108751 | A1 * | 8/2002 | Simpson | E21B 23/00 166/212 |
| 2002/0129976 | A1 | 9/2002 | Rastegar | |
| 2008/0029304 | A1 | 2/2008 | LeBlanc et al. | |
| 2011/0114307 | A1 | 5/2011 | Casassa et al. | |
| 2011/0114338 | A1 | 5/2011 | Casassa et al. | |
| 2011/0240313 | A1 * | 10/2011 | Knobloch, Jr. | E21B 17/04 166/381 |
| 2014/0311753 | A1 * | 10/2014 | Hanson | E21B 33/0415 166/378 |

FOREIGN PATENT DOCUMENTS

| | | | |
|---|---|---|---|
| EP | 0140311 | A1 | 8/1985 |
| GB | 2216961 | A | 10/1989 |
| WO | WO2009132301 | A1 | 10/2009 |
| WO | WO2012069795 | A2 | 5/2012 |
| WO | 2012143722 | A2 | 10/2012 |
| WO | WO2012143722 | A2 | 10/2012 |
| WO | 2013050131 | A1 | 4/2013 |
| WO | 2013121231 | A2 | 8/2013 |

* cited by examiner

DOWNHOLE APPARATUS AND METHOD

CROSS REFERENCE TO RELATED APPLICATION

This application claims the benefit of PCT International Application Serial No. PCT/GB2014/051645 filed on May 29, 2014, which claims priority to GB 1309853.8 filed on May 29, 2013, the entire disclosures of which are incorporated herein by reference.

FIELD OF THE INVENTION

This invention relates to a downhole apparatus and method. More particularly, but not exclusively, embodiments of the invention relate to a downhole bearing apparatus for reducing the effects of parasitic torsional losses in high angle or horizontal drilling applications in the oil and gas industry.

BACKGROUND TO THE INVENTION

Within the oil and gas industry, the continuing search for and exploitation of oil and gas reservoirs has resulted in the development of directionally drilled boreholes, that is boreholes which extend away from vertical and which permit the borehole to extend into the reservoir to a greater extent than with conventional vertical well boreholes. This type of well borehole is often referred to as an Extended Reach Development well or "ERD" well and in many cases the well borehole is drilled at a high angle from vertical or horizontally for a considerable distance.

In order to transmit mechanical power downhole for the drilling process, or to prevent deferential sticking, it is typically necessary to manipulate drilling tubulars from surface, either by rotating the drill string from surface and/or by transmitting weight from the tubulars in the more vertical section of the wellbore to the drill bit at the bottom.

However, it will be recognised that in high angle or horizontal wellbores, the majority of the tubulars of the string will be lying on the low side of the borehole with their weight acting on the borehole wall. This generates considerable cumulative friction when the tubulars are manipulated from surface; this taking the form of torsional or rotational friction in the case where the tubulars are rotated. Torsional or rotational friction therefore becomes a significant limiting factor in the length of high angle and horizontal borehole that can be achieved in any given size of hole.

The main factor that contributes to this limitation is cumulative torque, which can be calculated from the vertical cumulative weight of the tubulars in the high angle and/or horizontal section multiplied by the friction coefficient (normally taken at between 0.2 and 0.3 for cased and open borehole respectively) multiplied by the radius at which borehole contact is made. By way of example, 10,000 ft. of drilling tubular in open borehole with an average vertical weight component of 26 lbs per linear ft. acting at a contact radius of 3.39 inches with a friction coefficient of 0.3 would generate a cumulative torque of 10,000×26×(3.39 divided by 12)×0.3=22,035 ft./lbf. At an average drilling rotational speed of 150 rpm this would result in the loss of approximately 100 horsepower in frictional losses.

This frictional loss will increase as a function of borehole length and will eventually reach a point where the mechanical power input at surface is totally consumed before it reaches the bottom of the borehole and the drilling process will cease to be possible well before this point is reached.

Additionally and perhaps more importantly, as the torsional friction losses increase so will the torsional input requirement at surface to the point where the threaded connections in the jointed drilling tubulars reaches a point approaching their makeup torque. Continuing to drill beyond this borehole distance therefore risks potential torsional failure or twist off of the drilling tubulars.

There are a number of downhole tools currently in use in the oil industry which seek to address friction loss and reduce the frictional coefficient of the rubbing contact of rotating tubulars lying on the low side of the borehole. Conventional tools generally consist of a non-rotating bearing sleeve mounted on the body of the drilling tubulars or mounted on a sub-based tool installed between the threaded connections of the drilling tubulars. However, there are a number of problems associated with these conventional types of non-rotating bearing sleeves. For example, there are problems associated the methods of fixture of non-rotating sleeve and bearings to the body of the tubulars; with the use of split sleeves and clamping mechanisms; bearing life limitations due to aggressive nature of drilling mud; sealed versus non-sealed bearings; cuttings debris tolerance; with the possibility of loss in hole of component parts in operation; and with temperature ratings of conventional bearings and seals.

SUMMARY OF THE INVENTION

According to a first aspect of the present invention there is provided a bearing for a downhole apparatus, the bearing comprising:

a body; and an upset portion extending radially outwards from the body, the body and the upset portion defining a channel for receiving fluid flow for lubricating the bearing.

Beneficially, a bearing according to embodiments of the present invention facilitates relative rotation between components of a downhole apparatus, in particular but not exclusively between a mandrel or tubular body and a collar or sleeve configured to engage a bore wall or bore-lining tubular wall, the channel permitting passage of fluid—in particular but not exclusively drilling mud or the like—through the bearing which lubricates the bearing in use and assists in reducing frictional losses experienced by the downhole apparatus.

By providing a bearing which is separate from other components of the downhole apparatus, the bearing may preferentially wear rather than the other components; obviating or at least mitigating damage to those other components which may otherwise be detrimental to manipulation of the tubular string from surface; increase rotational frictional losses and the like. This is particularly beneficial in a high angle or horizontal boreholes in which bore-engaging components, such as stabilisers, centralisers, collars and the like engage the low side of the borehole. The provision of a separate bearing also simplifies manufacture of the downhole apparatus, and permits the same bearing to be used with a variety of different downhole components, including but not limited to stabilisers, centralisers, collars and the like.

The bearing may comprise a fluid lubricated bearing, for example but not exclusively a drilling fluid (mud) lubricated bearing.

The bearing may be configured for location on a mandrel or tubular body of the downhole apparatus.

The bearing may be configured for location on another member of the downhole apparatus, for example but not exclusively a non-rotating collar or sleeve.

In use, the bearing may be interposed between the mandrel and the collar or sleeve, the bearing facilitating relative rotation between the collar and the mandrel. For example, in embodiments where the collar comprises a non-rotating collar the bearing may facilitate rotation of the mandrel—which may form part of a drill string or the like—relative to the collar.

The body may be of any suitable form and construction.

In particular embodiments, the body may comprise a modular construction.

The body may comprise a plurality of body portions.

In particular embodiments, the body may comprise two body portions, although it will be understood that the body may alternatively comprise three body portions, four body portions, five body portions, six body portions or any suitable number of body portions.

The body may comprise a first body portion. The first body portion may be c-shaped, part-annular or hemi-annular shaped in cross section. In particular embodiments, the first body portion may be hemi-cylindrical.

The body may comprise a second body portion. The second body portion may be c-shaped, part-annular or hemi-annular shaped in cross section. In particular embodiments, the first body portion may be hemi-cylindrical.

The body may comprise a split-ring.

Alternatively, the body may comprise a unitary construction.

The body may be annular.

The upset portion may be of any suitable form and construction.

The upset portion may extend axially, that is longitudinally with respect to the body. The upset portion may extend at least partially circumferentially with respect to the body.

In particular embodiments, the upset portion may define a spiral configuration.

The bearing may comprise a single upset portion.

Alternatively, and in particular embodiments, the bearing may comprise a plurality of upset portions.

Where the bearing comprises a plurality of upset portions, these may be located at circumferentially spaced positions around the bearing.

The channel may be of any suitable form and construction.

The channel may extend axially, that is longitudinally with respect to the body. The channel may extend at least partially circumferentially with respect to the body.

In particular embodiments, the channel may define a spiral configuration.

The bearing may comprise a single channel.

Alternatively, and in particular embodiments, the bearing may comprise a plurality of channels.

Beneficially, the channel or channels provide fluid and/or debris bypass in operation.

The bearing may comprise a unitary construction.

For example, the body and the upset portion may be integrally formed.

Alternatively, and in particular embodiments, the bearing may comprise a modular construction. Where the bearing comprises a modular construction, the upset portion may comprise a separate component formed or coupled to the body.

The bearing may comprise a composite component.

The bearing, or part of the bearing, may be constructed from a metallic material, metallic alloy or the like.

The bearing, or part of the bearing, may be constructed from a polymeric material. The bearing, or part of the bearing, may be constructed from an elastomeric material. The elastomeric material may comprise a filled elastomer. In particular embodiments, the elastomeric material may comprise HNBR or the like.

In particular embodiments, the bearing may comprise a metallic core or foundation encapsulated in an elastomeric material, the elastomeric material forming the upset portion.

A rotational lock arrangement may be provided, the rotational lock arrangement preventing rotation of the bearing relative to the mandrel or tubular body. The rotational lock may be of any suitable form and construction. For example, the rotational lock may comprise a male member configured to engage a corresponding female member provided on, or coupled to, the mandrel or tubular body. In particular embodiments, the rotational lock may comprise an axially or longitudinally extending tab or pin configured to engage a slot or recess in the mandrel or tubular body. Alternatively, the rotational lock may comprise a female member configured to engage a corresponding male member provided on, or coupled to, the mandrel or tubular body.

According to a second aspect of the present invention there is provided a downhole apparatus comprising:

a mandrel or tubular body; and a bearing according to the first aspect.

Beneficially, embodiments of the present invention may be attached or otherwise located on a mandrel or tubular body, such as a drilling tubing section, a completion tubing section, tubular string or the like, the bearing facilitating relative rotation between components of the downhole apparatus, the channel permitting passage of fluid—in particular but not exclusively drilling mud or the like—through the bearing which lubricates the bearing in use and assists in reducing frictional losses experienced by the downhole apparatus.

The downhole apparatus may further comprise the mandrel or tubular body.

The mandrel or tubular body may be configured for coupling to a tubular string, for example but not exclusively a drill string, a running string, a bore-lining tubular string, a completion string, or the like. In particular embodiments, the tubular body may be configured for coupling to the string at an intermediate position in the string.

The mandrel or tubular body may comprise a connector for coupling the tubular body to the tubular string. The connector may be of any suitable form. The connector may, for example, comprise at least one of a mechanical connector, fastener, adhesive bond, or the like. In some embodiments, the connector may comprise a threaded connector at one or both ends of the tubular body. In particular embodiments, the connector may comprise a threaded pin connector at a first end of the tubular body and a threaded box connector at a second end of the tubular body. In use, when the apparatus is run into the borehole the tubular body may be coupled to the string so that the first end having the threaded pin connector is provided at the distalmost or downhole end of the tubular body and so that the second end having the thread box connector is provided at the uphole end of the tubular body.

The tubular body may comprise a longitudinal bore extending at least partially therethrough. In use, the longitudinal bore may facilitate the flow of fluid through the apparatus.

The tubular body may comprise a thick wall tubular. The tubular body may comprise a section of drill pipe, drill collar or the like. The tubular body may comprise a section of bore-lining tubular. For example, the tubular body may comprise a section of casing or liner. In particular embodiments, the tubular body may comprise enhanced performance drill pipe (EPDP) or the like.

The apparatus may comprise a sub.

The mandrel or tubular body may define a bearing journal. For example, an outer section of the tubular body may be machined or otherwise formed to define a bearing journal onto which the bearing may be mounted.

The mandrel or tubular body may define a recess for receiving the bearing. In some embodiments, the recess may form the bearing journal. In some embodiments, the recess may be configured to receive the bearing. The provision of a recess in the mandrel or tubular body facilitates coupling between the bearing and the mandrel or tubular body.

The mandrel or tubular body may be configured to receive a collar.

The collar may comprise or form part of a stabiliser.

In use, the collar may be configured to engage a borehole wall (for example in an open hole application) or other tubular, such as casing or liner (for example in a cased hole application). The collar may be configured to support and/or offset the mandrel or tubular body from a wall of the borehole or tubular.

The collar may be rotatably mounted on the tubular body via the bearing.

Beneficially, embodiments of the present invention may support the mandrel or tubular body, for example a rotating drill string, completion string or the like, within a borehole or tubing section and reduce or mitigate frictional losses that may otherwise occur between the rotating tubular body and the borehole or tubing section, and it has been found that embodiments of the present invention may reduce the coefficient of friction between the tubular body and the borehole wall in a high angle or horizontal borehole from about 0.25 or 0.3 to about 0.1.

The collar may be of any suitable form and construction.

The collar may comprise a radially extending rib or blade or other upset diameter portion. In use, the rib or blade may engage the wall of the borehole or tubing section.

The apparatus may further a thrust bearing.

The apparatus may further comprise a lock ring.

According to a third aspect of the present invention, there is provided an assembly comprising one or more downhole apparatus according to the second aspect of the invention.

The downhole assembly may comprise a drilling assembly for drilling a borehole.

According to a fourth aspect of the present invention there is provided a method comprising:

providing a bearing according to the first aspect; and locating said bearing on a mandrel or tubular to form a downhole apparatus.

The method may comprise running the apparatus into a borehole.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
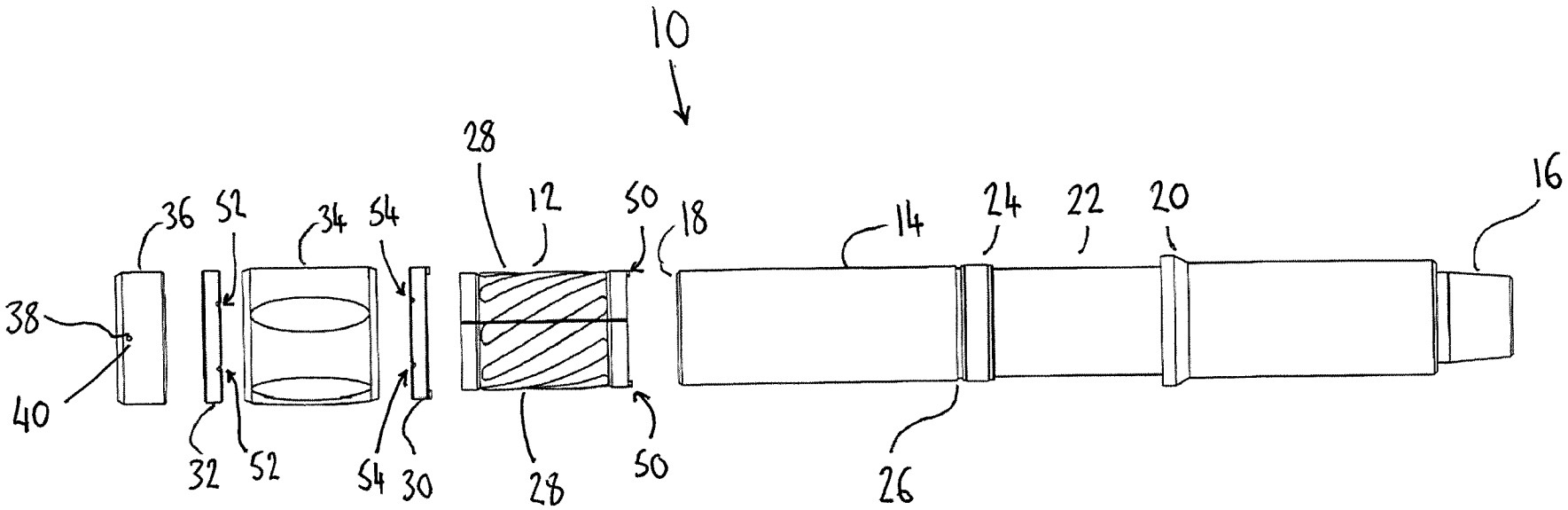
FIG. 1 shows an exploded view of a downhole apparatus including a bearing according to an embodiment of the present invention.

Referring first to FIG. 1 of the accompanying drawings, there is shown an exploded view of a downhole apparatus 10 including a bearing 12 according to an embodiment of the present invention As shown in FIG. 1, the apparatus 10 comprises a substantially tubular body 14, in the illustrated embodiment the body 14 comprising a single heavy walled tubular member with connection means in the form of a male threaded pin connection 16 and a female threaded box connection 18 provided at respective ends of the body 14 for coupling the apparatus 10 to adjacent downhole tools T1, T2. In use, the apparatus 10 takes the form of a downhole torque reduction sub.

As shown in FIG. 1, a central portion of the body 14 is profiled, comprising an upset 20, a recessed section 22, a threaded section 24, and a recessed groove 26. The profiled section is configured to accommodate the bearing 12 which in the illustrated embodiment comprises two split elastomeric bearing shells 28, as well as two thrust bearing rings 30, 32, non-rotating collar or sleeve 34 and a locking and attachment ring 36. This locking and attachment ring 36 is locked in place by means of a left hand thread (not shown) and locking screws 38 disposed in threaded bores 40. On assembly, the screws 38 engage the recessed groove 26 after the locking and attachment ring 36 has been screwed onto the threaded portion 24 of the body 14.

Figure 2:
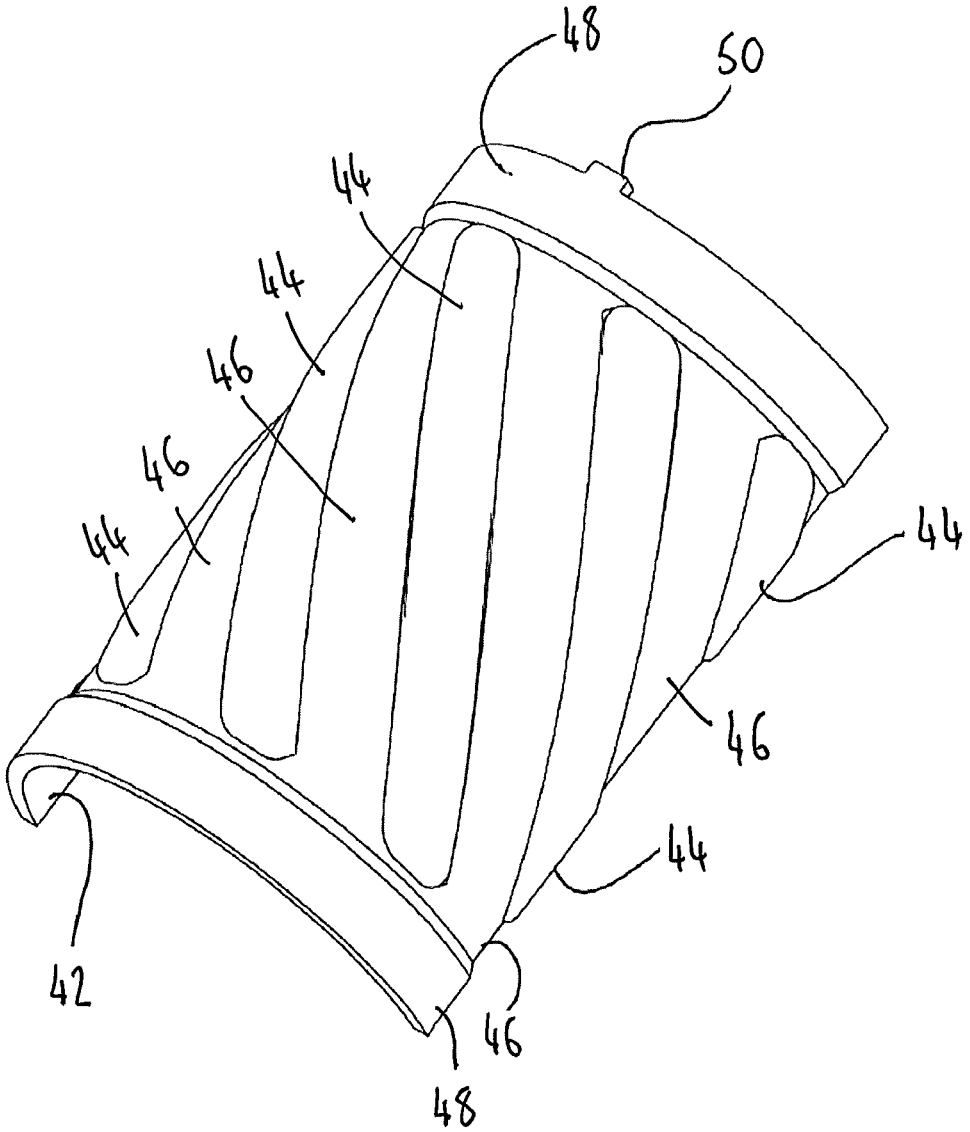
FIG. 2 shows an isometric view of one half of the bearing shown in FIG. 1.

Referring now also to FIG. 2 of the accompanying drawings, there is shown an isometric view of one of the bearing shells 28 which together form the bearing 12 of the apparatus 10.

As shown in FIG. 2, the bearing shell 28 comprises a generally hemi-cylindrical body 42 around which are disposed a plurality of upset portions 44. In the illustrated embodiment, the upset portions 44 take the form of spiraled or angled ribs, although the upset portions may alternatively take other forms such as distributed pads. Recesses or channels 46 are interposed between the upset portions 44, the channels 46 allowing clearance and flow path for mud or fluid lubrication and cooling of the elastomeric bearing surfaces formed between the upset portions 44 and an inner bore surface of the collar 34.

As shown in FIG. 2, the bearing body 42 further comprises end members 48, one of which comprises a rotational lock which in the illustrated embodiment comprises an anti-rotation tab 48 configured to engage a corresponding recess (see 49 in FIG. 3) at one end of the recessed section of the body 14. In use, the rotational lock prevents relative rotation between the bearing 12 and the body 14.

In the illustrated embodiment, the bearing 12 is manufactured as a composite with metallic polymer or composite foundation material on to which is bonded the elastomeric bearing profile.

Figure 3:
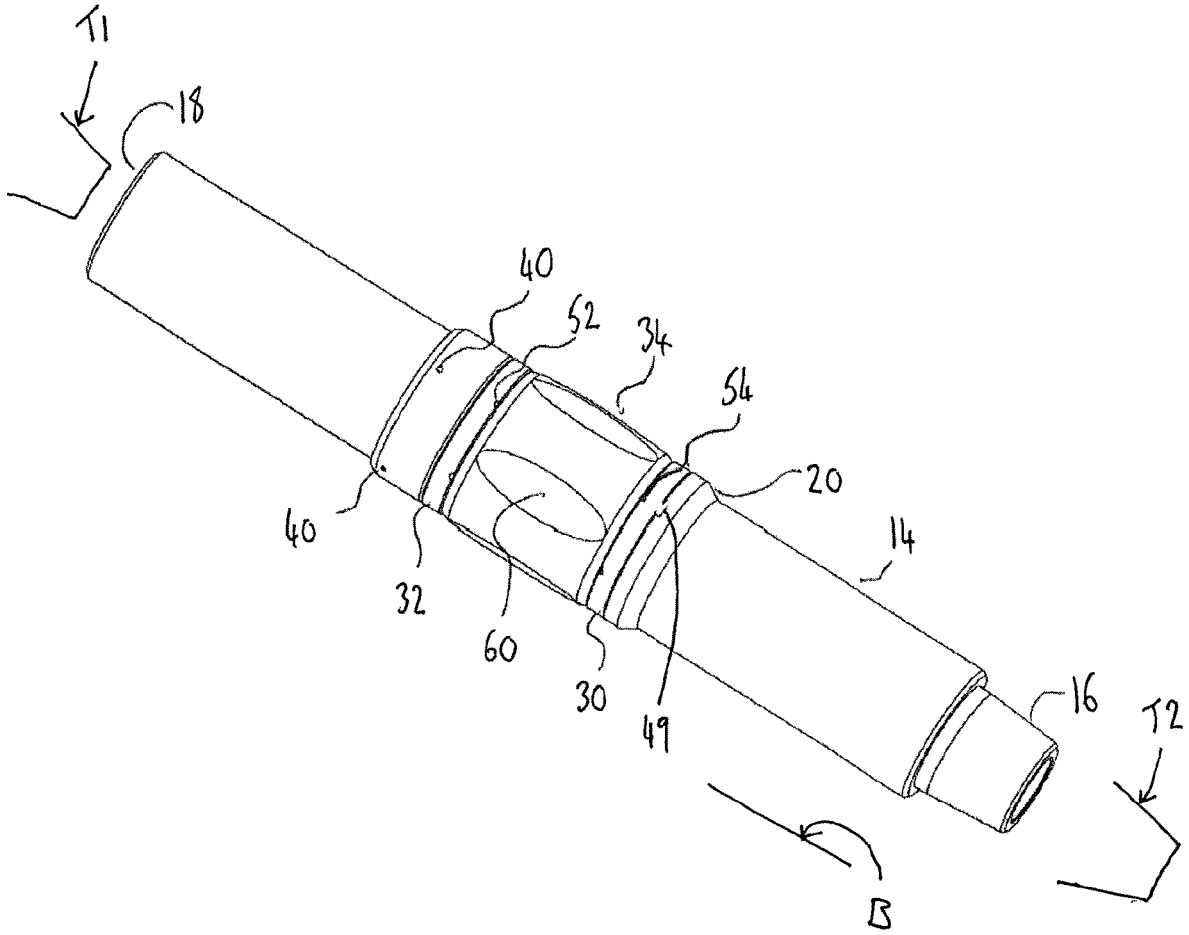
FIG. 3 shows an isomeric view of the downhole apparatus shown in FIG. 1, fully assembled as a downhole sub.

Referring now also to FIG. 3 of the accompanying drawings, there is shown an isometric view of the apparatus 10 in assembled form.

As shown in FIG. 3, the bearing 12 and the non-rotating collar 34 are mounted over the recessed section of the body 14, such that there is a running fit between the internal bore of the non-rotating collar 34 and the upset portions 44 of the bearing 12. As outlined above, the bearing 12 is prevented from rotation with respect to the body 14 by the main body 1 by the tabs 50 engaging in the recesses at the end of the recessed section of the body 14 (right end as shown in FIG. 3, although it will be understood that the tabs may be provided at either or both ends).

Thrust loads are carried by the thrust bearing rings 30, 32 respectively running on the end faces of the non-rotating collar 34. As can be seen from FIG. 3, the thrust bearing rings 30, 32 are located axially on the body 14 by means of the upset section 20 at one end and the locking attachment ring 24 at the other end, such that they maintain a running clearance between the end faces of the non-rotating sleeve 34. As shown in FIG. 3, mud or fluid inlet and outlet ports 52, 54 are provided in the thrust bearing rings 30, 32 in order to allow mud or fluid to enter through these ports 52 and into the space between the non-rotating collar 34 and the channels 46, to facilitate cooling and cleaning of the elastomeric bearing surfaces formed between the upset portions 44 on the inner bore surface of the non-rotating sleeve 34. In use, the spiraled or angled rib form of the upset portions 44 acts like an archimedes screw pump to induce flow through the bearing 12, entering through the ports 52 and exiting via the ports 54. In addition, anti-rotation flats or similar 60 are machined into the outer diameter of the collar bearing sleeve 11 to prevent preferential rotation when the torque reduction sub is operated in the borehole (shown diagrammatically at B).

In use, it will be recognised that the body 14 when rotating in the borehole B as part of a string of drilling tubulars is supported away from the low side of the borehole B and runs on a mud lubricated bearing 12.

It should be understood that the embodiments described herein are merely exemplary and that various modifications may be made thereto without departing from the scope of the invention.

For example, it is envisaged that a plurality of the apparatus' may be run in a string of drilling tubulars spaced at regular intervals along the high angle and horizontal sections of the borehole.

As outlined above, the use of these torque reduction sub is expected to reduce that friction coefficient to less than 0.1, the effect of this being a significant reduction in torque loss in the rotary drilling of high angle and horizontal borehole, reducing detrimental torsional losses in a given section of borehole by between approximately 30% and 60% and thereby increasing the torque transmitted to the drill bit and the drilling process by a similar margin improving drilling efficiency.

A torque reduction device utilising open mud lubricated elastomeric bearings for application in high angle and horizontal well bores to reduce the effect of parasitic torsional losses in high angle and horizontal rotary drilling applications. Moreover, by providing a bearing which is separate from other components of the downhole apparatus, the bearing may preferentially wear rather than the other components; obviating or at least mitigating damage to those other components which may otherwise be detrimental to manipulation of the tubular string from surface; increase rotational frictional losses and the like. This is particularly beneficial in a high angle or horizontal boreholes in which bore-engaging components, such as stabilisers, centralisers, collars and the like engage the low side of the borehole. The provision of a separate bearing also simplifies manufacture of the downhole apparatus, and permits the same bearing to be used with a variety of different downhole components, including but not limited to stabilisers, centralisers, collars and the like.

Embodiments of the present invention may also address the problem areas identified above by providing a tool where the loss of component parts is eliminated by the use of one piece main body and a one piece non-rotating sleeve 34 supported on open mud lubricated bearings which will be tolerant to mud solids while providing long life bearings with low coefficient of friction.

What is claimed is:

1. A downhole apparatus comprising:

a mandrel or tubular body;

a bearing comprising:

an annular body configured for location on and around the mandrel or tubular body;

an upset portion extending radially outwards from the annular body, wherein the annular body and the upset portion of the bearing defines a channel for receiving fluid flow for lubricating the bearing; and a rotational lock arrangement for preventing rotation of the bearing relative to the mandrel or tubular body; and a collar or sleeve rotatably mountable with the tubular body of said downhole apparatus via the bearing, wherein the collar or sleeve is configured to engage a bore wall or bore-lining tubular wall to support and/or offset the mandrel or tubular body of said downhole apparatus from said bore wall or bore-lining tubular wall, wherein the bearing is interposed between said collar or sleeve and said mandrel or tubular body, such that a bearing surface is formed between the radially extending upset portion of the bearing and an inner bore surface of the collar or sleeve, the bearing facilitating relative rotation between the mandrel or tubular body of said downhole apparatus and said collar or sleeve and reduce or mitigate frictional losses between the rotating tubular body and the bore wall or bore-lining tubular wall.

2. The downhole apparatus of claim 1, wherein at least one of:

the mandrel or tubular body defines a recess for receiving the bearing;

the mandrel or tubular body is configured to receive the collar;

the collar comprises a radially extending rib or blade or other upset diameter portion.

3. The downhole apparatus of claim 1, further comprising one or more thrust bearing.

4. The downhole apparatus of claim 3, wherein the thrust bearing comprises a fluid port for directing fluid to the bearing.

5. The downhole apparatus of claim 1, further comprising a lock ring.

6. The downhole apparatus of claim 1, wherein the bearing comprises a drilling fluid lubricated bearing.

7. The downhole apparatus of claim 1, wherein the bearing comprises a modular construction.

8. The downhole apparatus of claim 1, wherein the bearing comprises a plurality of body portions.

9. The downhole apparatus of claim 8, wherein the plurality of body portions comprises a first body portion and a second body portion.

10. The downhole apparatus of claim 8, wherein at least one of:

the first body portion is one of: c-shaped in cross section; part-annular in cross section; hemi-annular shaped in cross section; and hemi-cylindrical;

the second body portion is one of: c-shaped in cross section; part-annular in cross section; hemi-annular shaped in cross section; and hemi-cylindrical.

11. The downhole apparatus of claim 1, wherein the body comprises a split-ring.

12. The downhole apparatus of claim 1, wherein the body comprises a unitary construction.

13. The downhole apparatus of claim 1, wherein at least one of:

the upset portion extends axially with respect to the body;

the upset portion extends at least partially circumferentially with respect to the body;

the upset portion defines a spiral configuration.

14. The downhole apparatus of claim 1, wherein the bearing comprises a plurality of the upset portions.

15. The downhole apparatus of claim 1, wherein at least one of:

the channel extends axially with respect to the body;

the channel extends at least partially circumferentially with respect to the body;

the channel defines a spiral configuration.

16. The downhole apparatus of claim 1, wherein the bearing comprises a plurality of the channels.

17. The downhole apparatus of claim 1, wherein the bearing comprises a modular construction.

18. The downhole apparatus of claim 1, wherein the upset portion comprises a separate component formed or coupled to the body.

19. The downhole apparatus of claim 1, wherein the bearing comprises a composite component.

20. The downhole apparatus of claim 1, wherein the bearing or part of the bearing is constructed from a metallic material, metallic alloy or the like.

21. The downhole apparatus of claim 1, wherein the bearing or part of the bearing is constructed from a polymeric material.

22. The downhole apparatus of claim 1, wherein the bearing or part of the bearing is constructed from an elastomeric material.

23. The downhole apparatus of claim 1, wherein the elastomeric material comprises a filled elastomer.

24. The downhole apparatus of claim 1, wherein the bearing comprises a metallic core or foundation encapsulated in an elastomeric material, the elastomeric material forming the upset portion.

25. The downhole apparatus of claim 1, wherein the bearing comprises a metallic, polymer or composite foundation onto which is bonded an elastomeric bearing profile.

26. The downhole apparatus of claim 1, wherein the rotational lock comprises at least one of:

a male member configured to engage a corresponding female member provided on, or coupled to, the mandrel or tubular body;

an axially extending tab or pin configured to engage a slot or recess in the mandrel or tubular body.

27. The downhole apparatus of claim 1, wherein the rotational lock comprises a female member configured to engage a corresponding male member provided on, or coupled to, the mandrel or tubular body.

28. A downhole assembly comprising one or more downhole apparatus according to claim 1.

29. A method comprising:

providing a bearing, the bearing comprising:

an annular body configured for location on and around a mandrel or tubular body;

an upset portion extending radially outwards from the body, wherein the body and the upset portion define a channel for receiving fluid flow for lubricating the bearing; and a rotational lock arrangement for preventing rotation of the bearing relative to the mandrel or tubular body; and locating said bearing on a mandrel or tubular body, the rotational lock arrangement preventing rotation of the bearing relative to the mandrel or tubular body;

locating a collar or sleeve on the bearing to form a downhole apparatus, wherein the collar or sleeve is rotatably mountable with the tubular body of said downhole apparatus via the bearing, the collar or sleeve configured to engage a bore wall or bore-lining tubular wall to support and/or offset the mandrel or tubular body of said downhole apparatus from said bore wall or bore-lining tubular wall, wherein the bearing is interposed between said collar or sleeve and said mandrel or tubular body, such that a bearing surface is formed between the radially extending upset portion of the bearing and an inner bore surface of the collar or sleeve, the bearing facilitating relative rotation between the mandrel or tubular body of said downhole apparatus and said collar or sleeve and reduce or mitigate frictional losses between the rotating tubular body and the bore wall or bore-lining wall.

30. The method of claim 29, wherein the method comprises running the apparatus into the borehole.

* * * * *